United States Patent [19]

Anderson et al.

[11] 4,063,243

[45] Dec. 13, 1977

[54] CONFORMAL RADAR ANTENNA

[75] Inventors: Wallace E. Anderson, Beltsville; Albert D. Krall, Rockville; Albert M. Syeles; Oscar J. Vansant, both of Silver Spring, all of Md.

[73] Assignee: The United States of America as represented by the Secretary of the Navy, Washington, D.C.

[21] Appl. No.: 581,470

[22] Filed: May 27, 1975

[51] Int. Cl.[2] ..... H01Q 3/26

[52] U.S. Cl. ..... 343/100 SA; 343/854; 343/876

[58] Field of Search ..... 343/100 SA, 854, 876

[56] References Cited

U.S. PATENT DOCUMENTS

| | | | |
|---|---|---|---|
| 3,276,018 | 9/1966 | Butler | 343/100 SA |
| 3,295,134 | 12/1966 | Lowe | 343/100 SA |

*Primary Examiner*—Maynard R. Wilbur
*Assistant Examiner*—Richard E. Berger
*Attorney, Agent, or Firm*—R. S. Sciascia; A. L. Branning; R. E. Bushnell

[57] ABSTRACT

A conformal electronically scanned antenna array system utilizing an inverse Butler matrix in combination with directive antenna elements. The system provides a simple and inexpensive device for scanning an elemental array without the problems of output frequency shift or mutual coupling between antenna elements.

18 Claims, 4 Drawing Figures

CONFORMAL RADAR ANTENNA

BACKGROUND OF THE INVENTION

The present invention pertains generally to electronically scanned antennas and more particularly to scanned directive antenna arrays. An outstanding problem in naval fire control is the simultaneous tracking of multiple targets. This problem is partially solved by the use of electronically scanned antenna arrays. However, due to the complexity (mutual impedance and complex computerized steering commands) and resultant cost of these systems, their use has been fairly limited in the Naval Fleet.

Another configuration which has been considered is a series of single radar beams produced by directive antenna elements which are selectively addressed in accordance with their placement in space to effectuate a steered output beam. End fire antenna elements, e.g., dielectric rods, have advantages over alternative beam directors such as parabolic reflectors, lenses, and antenna subarrays since they occupy considerably less cross-sectional surface area than the others. The physical length of the end fire antenna elements however have virtually eliminated their use.

In studying the physical characteristics of end fire rod antennas, diffraction theory indicates that if D represents the maximum antenna diameter and $\lambda$ the responsive antenna wavelength, then the minimum angle $\theta$ of the antenna beam within which radiation can be concentrated is proportional to $\lambda/D$. Therefore, to achieve small angles, $\lambda$ must be small and D large. However, both $\lambda$ and D are constrained by other system characteristics.

The wavelength $\lambda$ is basically restricted in radar to a limited range of wavelengths. Therefore, the only method of restricting the angle $\theta$ is to increase D. By making D large in a discrete elemental linear array (D is now the length of the linear array) and phasing the array for end fire (i.e., lining up a series of dipole elements and phasing each successive dipole by 90° so that the beam is emitted along the line of the array), the cross-sectional dimension of the array is made independent of D (length of the array) and is only restricted by the size of a single antenna element. This is usually on the order of a wavelength or less which, for I band, is about 3 cm.

Dielectric rods are ideal substitutes for the discrete elemental linear array phased for end fire since they can be easily phased for end fire due to their inherent physical characteristics, they can be constructed of any one of a number of low loss materials available, and they are easily matched for impedance over a wide range of frequencies.

However, the half power beam width (HPBW) of a dielectric rod antenna indicates that:

$$HPBW\ (\text{degrees}) \simeq \frac{60}{\sqrt{\text{length of rod in free space measured in wavelengths}}}$$

Using I band ($\lambda = 3$ cm), a 6° HPBW requires a rod of approximately 3 meters ($\simeq$ 10 ft.). Evan if the Hansen-Woodyard supergain relation is applied, a "10 foot pole" would only produce a 4° beam or could be reduced to a "7 foot pole" to retain a 6° HPBW beam which is still clearly unsuitable for use in an array.

Even if a smaller directive antenna were available, a conformal scanning system would be needed to address the directive elements. Such a system would be required to provide a simple and inexpensive method for selectively addressing directive antenna elements of the array to provide an orderly manner of scanning in three dimensions.

SUMMARY OF THE INVENTION

The present invention overcomes the disadvantages and limitations of the prior art by providing a conformal radar antenna scanning system. The system utilizes an inverted Butler matrix in combination with an array of directive antenna elements to scan in three dimensions. The Butler matrix acts as a linear passive reciprocal network for concentrating a series of input signals on a single output which is thereafter applied to a directive antenna element.

It is therefore an object of the present invention to provide an improved antenna scanning array.

It is also an object of the present invention to provide an inexpensive and simple scanned array antenna system.

Another object of the present invention is to provide a conformal antenna array which can be easily and inexpensively scanned in three dimensions without being constrained to any particular physical shape.

Other objects, advantages and novel features of the invention will become apparent from the following detailed description of the invention when considered in conjunction with the accompanying drawings wherein:

DETAILED DESCRIPTION OF THE PREFERRED EMBODIMENT

Figure 1:
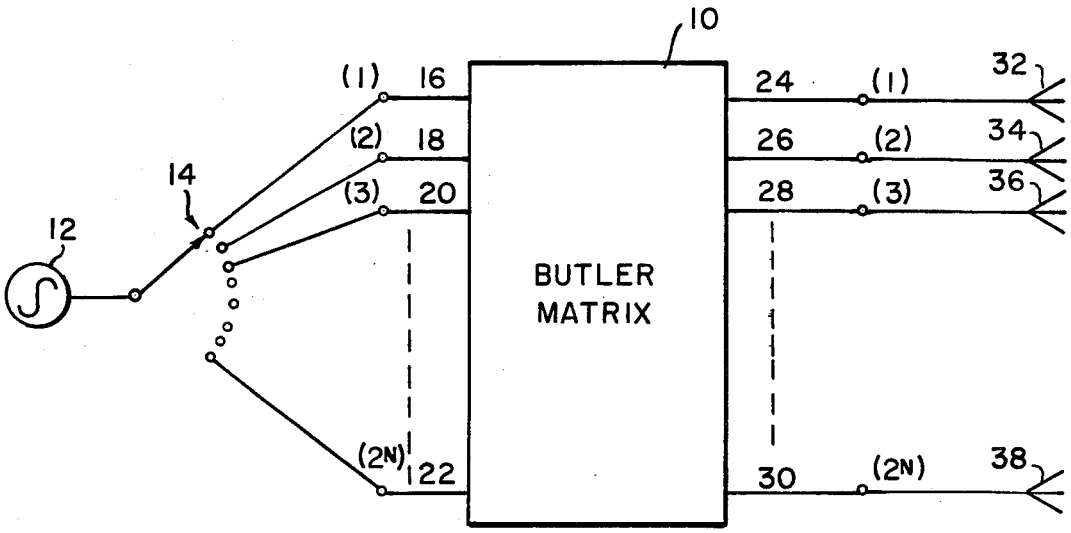
PRIOR ART FIG. 1.
FIG. 1 is an illustration of a conventional Butler matrix.

FIG. 1 discloses a typical Butler matrix scanning configuration as disclosed on "Beam Forming Matrix Simplifies Design Of Electronically Scanned Antennas" by J. Butler and R. Lowe, Electronic Design, Vol. 9, pp. 170–173, Apr. 12, 1961. The Butler matrix 10 shown in FIG. 1, is an array of hybrid couplers and fixed phase shifters that have an equal binary number of inputs 16 to 22 and outputs 24 to 30. In its usual mode, a linear array of antenna elements 32 to 38 are connected to output terminals 24 to 30. When a coherent power source 12 is connected to one of the input terminals 16, the matrix distributes the input power signal to all the outputs 24 to 30 and from there, to the antenna elements 32 to 38, with a linear phase shift between each adjacent terminal. For example, when source 12 is connected to input 16, the signal appears on each of the output terminals 24 to 30 with a progressive linear phase shift between adjacent terminals. Therefore, if output 24 has a zero phase shift when compared to the input signal, then output 26 might have a 10° phase shift and output 28 might have a 20° phase shift and output 30 a $10 \times 2^n$ degree phase shift (where $n$ is the number of terminals) when compared to the input signal thereby rendering a progressive linear phase shift of 10° between each adjacent output terminal. As the source 12 is applied to different input terminals 18 to 22, the only change at the output terminals is the amount of phase shift that exists between adjacent terminals, i.e., input 18 may produce 20° phase shifts between adjacent output terminals, input 20, 30° phase shifts, etc., or any suitable progression of phase shifts desired. Since the array of antenna elements 32–38 interact mutually, an output beam from the array can be steered across space. The matrix is therefore capable of producing $2^n$ distinct output beam positions in space from the antenna array with each position uniquely defined by a predetermined input position.

Figure 2:
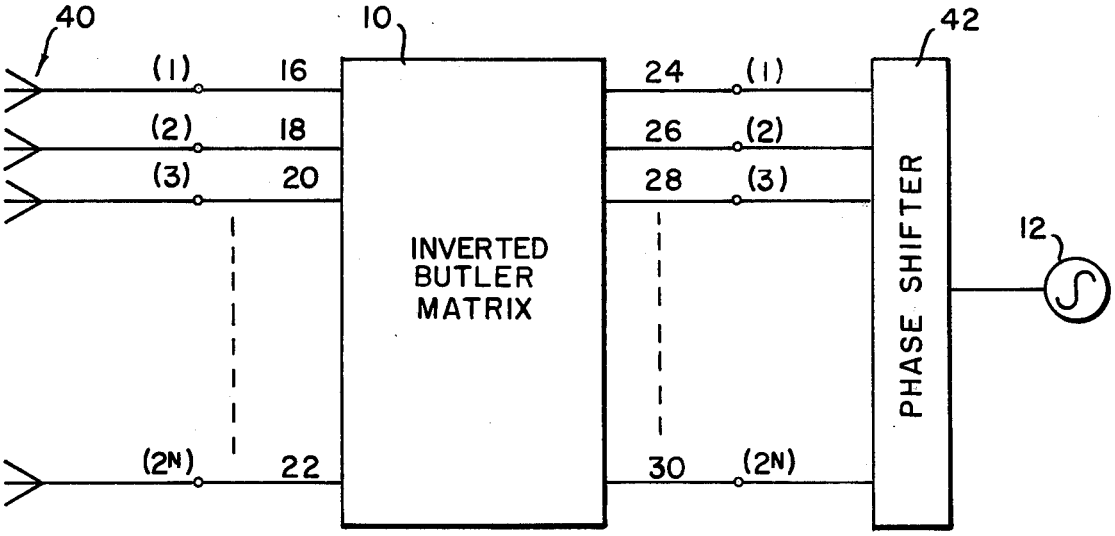
FIG. 2 is an illustration of one embodiment of the present invention.

FIG. 2 discloses the preferred system of the present invention. The system comprises a Butler matrix 12 used in a reverse manner, a series of directive antenna elements 40, a phase shifter 42 and a coherent power source 12. Suitable directive antenna elements for use with the preferred embodiment are disclosed in U.S. application Ser. No. 565,292, entilted "Conformal Radar Antenna Utilizing Directive Antenna Elements" filed on Mar. 25, 1975, by W. E. Anderson, A. D. Krall, A. M. Syeles, and O. J. VanSant. The directive antenna elements disclosed therein have a sufficiently small propagation angle and are physically small enough to make the present system feasible.

Since the Butler matrix 10 is passive and linear it may be used in a reciprocal manner as shown in FIG. 2. By applying an input signal to what would normally be the outputs 24 to 30, the input can be summed to appear on one of the antenna ports 16 to 22 by adjusting the phase of the input signals. Using a prior example, if a linearly progressive phase change of 10° were introduced between 24, 26, 28, . . . 30, the entire signal would be summed to appear at antenna port 16 of FIG. 2. By changing the amount of phase shift, alternate or multiple ports can be selected. Since each antenna port is terminated by a narrow beam antenna, the propagated beam can be positioned to point anywhere in space. The antennae have no mutual dependance or coupling between each other and can therefore be mounted in any desired manner rendering the system fully conformal. The physical destruction of any group of antennas results in a loss of communication only from the assigned space coverage of that group.

The phase change between adjacent input terminals is provided by a phase shifter 42 connected to the coherent source 12. Any number of phase shifters would be suitable for use in the device as, for example, diode phase shifters, which are capable of selectively activating one or several delay lines to produce the proper delay; a tapped delay line which provides a progressive phase change as the output frequency is changed; a ferrite phase shifter which reacts to magnetic fields to produce phase changes; or the modified Huggins scanning system disclosed in application Ser. No. 379,859 now U.S. Pat. No. 3,953,852 entitled "Wide Bandwidth Phase Scanning With Simple Controls" filed July 13, 1973 by W. E. Anderson, A. D. Krall, A. M. Syeles, and O. J. VanSant. Any of the above systems or any suitable phase shifter could be used with the present device although the latter mentioned device would be preferred since it allows separate adjustment of both output frequency and phase shift without any dependance between the two in a simple and inexpensive device.

The primary advantage of the present invention is that it allows an array of directive elements to be scanned in a simple manner without the necessity of complex computer controlled commands. The system provides conformal scanning over $2^n$ beam positions in space without the problems of mutual impedances and switching commands.

Figure 3:
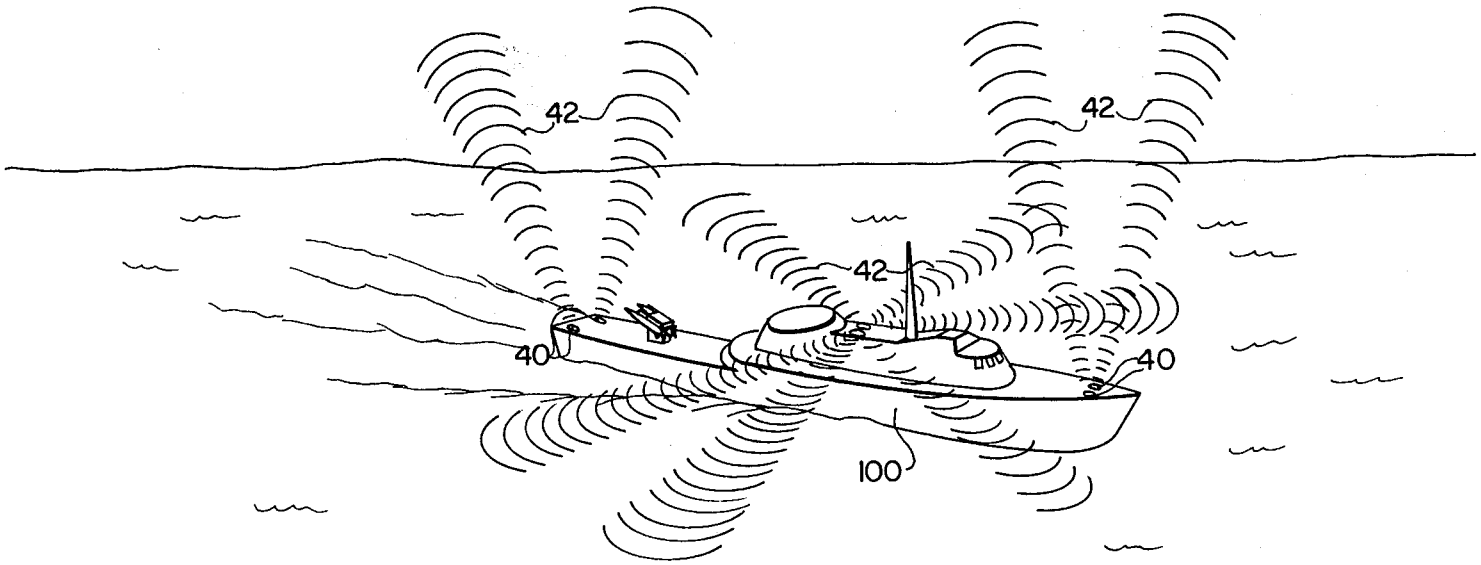
FIG. 3 is an illustration of the application of an embodiment of the present invention with an array of a plurality of directive antenna elements, each with an unique orientation.
Figure 4:
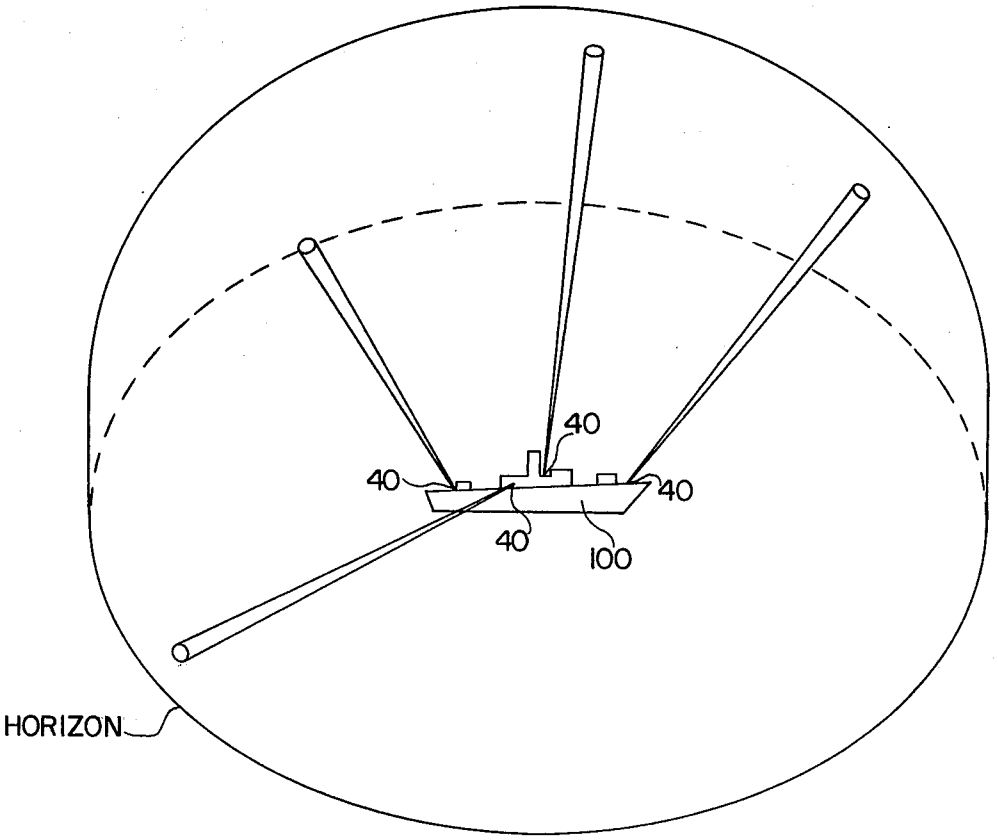
FIG. 4 is a reduced illustration of the application presented in FIG. 3 showing the beams of four directive antenna elements, each element belonging to a different linear array, against the hemisphere scanned.

Referring now to FIG. 3, a ship 100 is shown upon which a plurality of directive antenna elements 40 are mounted. Each element 40 has a unique orientation and projects a distinct beam 42 into space. Obviously, several linear arrays, the antenna elements 40 of each being fed by one of an equal number of inverted Butler matrices 10, may be mounted on the same ship in order to provide greater coverage. FIG. 4 is a reduced view of the scene of FIG. 3, in which four antenna elements 40, each belonging to a different linear array, independently project distinct narrow beams 42 against the hemisphere scanned.

Obviously many modifications and variations of the present invention are possible in light of the above teachings. For example, the present system could be used to receive or propagate a beam scanned in space. If the system were used to receive signals the source 12 would constitute a receiver and phase shifter 12 could be referred to as a phase detector.

It is therefore to be understood that within the scope of the appended claims the invention may be practiced otherwise than as specifically described.

What is claimed as new and desired to be secured by Letters Patent of the United States is:

1. A system for conformally scanning an array of antennas in space comprising:

a coherent signal source;

means for providing a series of first output signals from said coherent signal source on a series of outputs having a progressive linear phase shift between adjacent outputs;

matrix means for condensing said series of first output signals to one of a series of second outputs; and, directive antenna elements connected to said series of second outputs.

2. The device of claim 1 wherein said means for providing comprises a phase shifter.

3. The device of claim 1 wherein said matrix means comprises a Butler matrix.

4. The device of claim 2 wherein said matrix means comprises a Butler matrix.

5. An electronically scanned antenna array system for scanning a beam in space comprising:

scource means for providing a coherent microwave electronic signal;

means connected to said source means for providing a plurality of ouptput signals having a linear progressive phase shift between adjacent output signals;

linear matrix means for passively encoding said plurality of output signals in accordance with the magnitude of said progressive linear phase shift to concentrate said plurality of output signals on at least one matrix output; and, directive antenna elements connected to each matrix output for scanning a beam in the direction of said directive antenna element.

6. The system of claim 5 wherein said linear matrix means conprises an inverted Butler matrix.

7. The system of claim 5 wherein said means for providing a plurality of output signals comprises a modified Huggins scanner.

8. An electronically scanned antenna array system for scanning a beam in space comprising:

a plurality of directive antenna elements for receiving signals from a plurality of directions in space;

passive matrix means for encoding each of said signals received from said directive antenna elements into a plurality of output signals having a linear progressive phase shift between adjacent output signals;

means connected to said passive matrix means for detecting linear progressive phase shifts to produce a single phase detector output representative of the output of one or more of said plurality of directive antenna elements; and, means for receiving said single phase detector output.

9. The system of claim 8 wherein said passive matrix means comprises an inverted Butler matrix.

10. A system for conformally scanning an array of antennae in space comprising:

a coherent signal source;

means for providing a series of first output signals from said coherent signal source on a series of outputs having a progressive linear phase shift between adjacent outputs;

matrix means for condensing said series of first output signals to a selected one of a series of second outputs; and, directive antenna elements each connected to a different one of said series of second outputs.

11. The device of claim 10 wherein said means for providing comprises a phase shifter.

12. The device of claim 10 wherein said matrix means comprises a Butler matrix.

13. The device of claim 11 wherein said matrix means comprises a Butler matrix.

14. An electronically scanned antenna array system for scanning a beam in space comprising:

source means for providing a coherent microwave electronic signal;

means connected to said source means for providing a plurality of output signals having a linear progressive phase shift between adjacent output signals;

linear matrix means for passively encoding said plurality of output signals in accordance with the magnitude of said progressive linear phase shift to concentrate said plurality of output signals on at least one matrix output; and, directive antenna elements connected to each said matrix output for scanning a beam in the direction of said directive antenna element.

15. The system of claim 14 wherein said linear matrix means comprises an inverted Butler matrix.

16. The system of claim 14 wherein said means for providing a plurality of output signals comprises a modified Huggins scanner.

17. A system for conformally scanning an array of antennae in space comprising:

a coherent signal source;

means for providing a series of first output signals from said coherent signal source on a series of outputs naving a progressive linear phase shift between adjacent outputs;

matrix means for condensing said series of first output signals to a sequentially selected one of a series of second outputs; and, directive antenna elements each connected to a different one of said series of second outputs.

18. A system for conformally scanning an array of antennae in space comprising:

a coherent signal source;

means for providing a series of first output signals from said coherent signal source on a series of outputs having a progressive linear phase shift between adjacent outputs;

matrix means for passively encoding said series of first output signals in accordance with the magnitude of said progressive linear phase shift to concentrate said first output signals on at least one matrix output; and, directive antenna elements each connected to a different said matrix output.

* * * * *